US008597062B2

(12) United States Patent
Casses et al.

(10) Patent No.: US 8,597,062 B2
(45) Date of Patent: Dec. 3, 2013

(54) ELECTRICAL CONTACT

(75) Inventors: Claude Casses, Clevilliers (FR); Patrice Cappe, Faverolles (FR); Jean-Paul David, Cintray (FR); Gerard Mulot, Nogent le Roi (FR)

(73) Assignee: Delphi International Operations Luxembourg, S.A.R.L. (LU)

( * ) Notice: Subject to any disclaimer, the term of this patent is extended or adjusted under 35 U.S.C. 154(b) by 287 days.

(21) Appl. No.: 12/998,032

(22) PCT Filed: Sep. 10, 2008

(86) PCT No.: PCT/IB2008/055608

§ 371 (c)(1),
(2), (4) Date: Apr. 5, 2011

(87) PCT Pub. No.: WO2010/029391

PCT Pub. Date: Mar. 18, 2010

(65) Prior Publication Data

US 2011/0177722 A1 Jul. 21, 2011

(51) Int. Cl.
*H01R 13/502* (2006.01)

(52) U.S. Cl.
USPC ..... 439/686; 439/732; 439/854; 439/881

(58) Field of Classification Search
USPC ..... 439/854, 855, 879, 881, 891, 685, 686, 439/752.5, 732
See application file for complete search history.

(56) References Cited

U.S. PATENT DOCUMENTS 1,014,718 A * 1/1912 Parsons ..... 439/502
1,930,639 A * 10/1933 Berthold ..... 439/854
1,964,541 A * 6/1934 Soreny ..... 439/569
2,075,632 A * 3/1937 Zuckerman ..... 439/222
2,239,878 A * 4/1941 Clayton ..... 439/646
2,848,706 A * 8/1958 Besserer ..... 439/514
2,968,787 A * 1/1961 Wootton ..... 439/750
3,474,386 A * 10/1969 Link ..... 439/181
3,551,879 A * 12/1970 Waller, Sr. ..... 439/369
4,012,105 A * 3/1977 Biddle ..... 439/675
4,109,992 A * 8/1978 Hughes et al. ..... 439/620.21
4,195,894 A * 4/1980 Kotski ..... 439/101
4,210,382 A * 7/1980 Culbertson ..... 439/682
4,225,206 A * 9/1980 Roman, Jr. ..... 439/274
4,684,202 A * 8/1987 House et al. ..... 439/752
5,011,439 A * 4/1991 Pawlicki ..... 439/847
5,288,242 A * 2/1994 Muzslay ..... 439/349
5,399,103 A * 3/1995 Kuboshima et al. ..... 439/509
5,435,754 A * 7/1995 Hotea et al. ..... 439/620.21
5,591,041 A * 1/1997 Cecil et al. ..... 439/352

(Continued)

FOREIGN PATENT DOCUMENTS

DE 102 11 634 A1 10/2003
DE 20 2006 008 718 U1 10/2007
EP 0 767 514 A1 4/1997
EP 1 041 675 A2 10/2000

*Primary Examiner* — Neil Abrams
(74) *Attorney, Agent, or Firm* — Robert J. Myers

(57) ABSTRACT

The electrical contact includes a wire crimping portion receiving an electrical wire, a cylindrical power contact portion for connection with a complementary contact. The power contact portion comprises includes a body mechanically retained on the wire crimping portion and spring legs depending from the body and to be contacted with the complementary contact. The electrical contact further includes an electrically insulating cover covering the spring legs. The cover additionally includes fool proof features to prevent incorrect assembly of the cover into passages of the housing.

13 Claims, 8 Drawing Sheets

(56) References Cited

U.S. PATENT DOCUMENTS

| | | | | | |
|---|---|---|---|---|---|
| 5,609,498 | A * | 3/1997 | Muzslay | 439/352 |
| 5,628,643 | A * | 5/1997 | Yoshida | 439/218 |
| 5,662,500 | A * | 9/1997 | Yeah | 439/732 |
| 5,667,413 | A * | 9/1997 | Trafton | 439/843 |
| 5,791,946 | A * | 8/1998 | Mendez | 439/860 |
| 5,957,734 | A * | 9/1999 | Gladd et al. | 439/857 |
| 5,997,367 | A * | 12/1999 | Nowak et al. | 439/853 |
| 6,159,054 | A * | 12/2000 | Ko | 439/680 |
| 6,234,843 | B1 * | 5/2001 | Pavlovic | 439/620.07 |
| 6,283,794 | B1 * | 9/2001 | Osuga | 439/620.05 |
| 6,328,615 | B1 * | 12/2001 | Safai | 439/851 |
| 6,354,890 | B2 * | 3/2002 | Adkins et al. | 439/843 |
| 7,029,335 | B2 * | 4/2006 | Osada | 439/694 |
| 7,086,908 | B2 * | 8/2006 | Fukuzaki et al. | 439/669 |
| 7,108,565 | B2 * | 9/2006 | Boischio | 439/694 |
| 7,150,631 | B2 * | 12/2006 | Reed et al. | 439/34 |
| 7,241,175 | B2 * | 7/2007 | Johannes et al. | 439/620.05 |
| 7,530,861 | B2 * | 5/2009 | Nakamura | 439/854 |
| 7,607,957 | B1 * | 10/2009 | Ho et al. | 439/879 |
| 7,794,256 | B1 * | 9/2010 | Sochor | 439/289 |
| 7,892,026 | B2 * | 2/2011 | Langhoff et al. | 439/607.02 |
| 7,950,968 | B2 * | 5/2011 | Qian | 439/689 |
| 7,988,475 | B2 * | 8/2011 | Sakakura | 439/271 |
| 8,192,229 | B2 * | 6/2012 | Endo | 439/596 |
| 8,282,426 | B2 * | 10/2012 | Zweigle | 439/733.1 |
| 2011/0177722 | A1 * | 7/2011 | Casses et al. | 439/660 |

* cited by examiner

ELECTRICAL CONTACT

FIELD OF THE INVENTION

The instant invention relates to electrical contacts, sets of electrical contacts, for instance for connector used in motorized vehicles, products and assemblies comprising such electrical contacts, their methods of manufacture and methods of electrical connection.

BACKGROUND OF THE INVENTION

Electrical connectors are used for connecting electrical appliances together. For example, in the automotive industry, electrically powered cars (or partly electrically powered cars, such as so-called "hybrid" cars) are emerging as an interesting alternative to the fuel-only vehicles. This requires new generations of connectors for supplying electrical motors with higher voltages than those required for appliances such as window-lifters, radio, etc. . . . ).

A certain class of electrical connectors usable in this context is made as an electrically insulating housing comprising three ways. In each of these ways, an electrical contact which is crimped on a cable is inserted.

An example of electrical contact is describes for instance in DE 1 02 11 634. This contact comprises a wire crimping portion crimped on an electrical wire and a power contact portion having a cylindrical shape for accommodating a complementary contact. The power contact portion is provided with a barrel with a plurality of contact blades elastically curved toward the central and longitudinal axis of the cylindrical power contact portion.

After its crimping on the wire, this contact is integrally incorporated in an insulating plastic housing comprising two separate top and bottom parts mechanically locked to one another.

The instant invention has notably for object to make easier the manufacturing of such a contact.

SUMMARY OF THE INVENTION

To this aim, it is provided an electrical contact according to claim 1.

With these features, the electrical contact is provided with a plurality of spring legs integral with the power contact portion. This ensures direct paths for the current as well as a large surface of electrical connection between the contact and its mating contact. Further, a cover will protect the spring legs against any damage that might occur during handling, transportation or storage occurring between the manufacturing of the contact, and its insertion in the housing. Thought, the number of parts of the contact is reduced with regard to the contact disclosed in DE 1 02 11 634, making the manufacturing process easier.

In some embodiments, one might also use one or more of the features as defined in the dependent claims.

Such contacts could alternatively be used for other applications than the electrical automotive application.

BRIEF DESCRIPTION OF THE DRAWINGS

Other characteristics and advantages of the invention will readily appear from the following description of one of its embodiments, provided as a non-limitative example, and of the accompanying drawings.

On the drawings.

On the different figures, the same reference signs designate like or similar elements.

DETAILED DESCRIPTION

Figure 1:
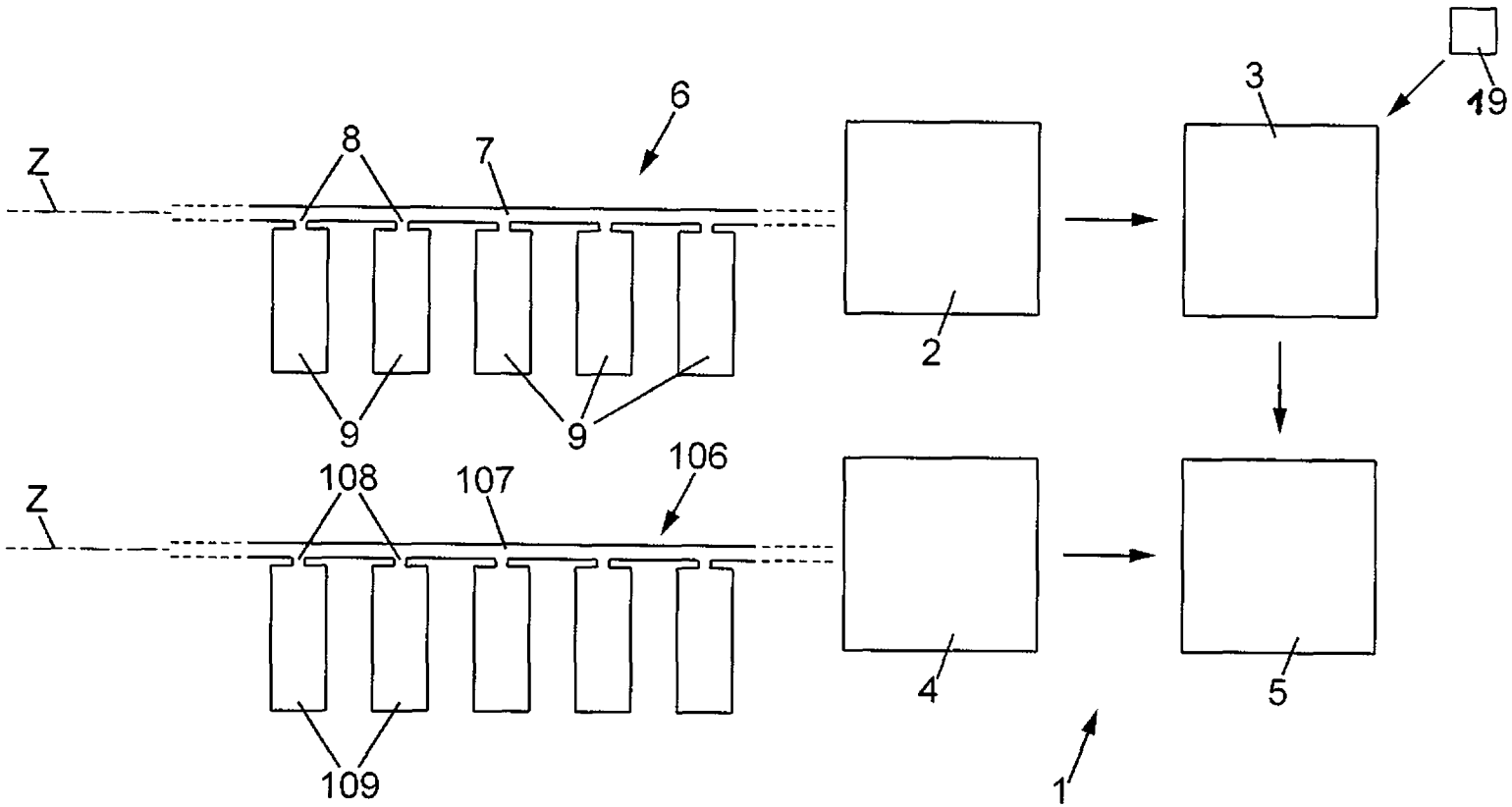
FIG. 1 is a schematic representation of a manufacturing apparatus.

FIG. 1 schematically shows an apparatus 1 for the manufacture of an electrical contact. The apparatus comprises, for example, a crimping portion forming station 2, a first assembly station 3, a power contact portion forming station 4 and a second assembly station 5. The crimping portion forming station 2, the first assembly station 3 and the second assembly station 5 are for example disposed in line and adapted to perform series of operations continuously on a blank 6 of material. The blank 6 is for example provided in a shape of a continuous strip 7 to which are connected, through respective connecting portions 8, pieces 9 to be formed. These pieces 9 are electrically conducting, for example metallic or of a metallic alloy such as a copper alloy. For example, the blank 6 as represented on FIG. 1 was previously obtained by forming from a plane conductive thin plate.

The crimping portion forming station 2 needs not to be described in more details. It is sufficient to explain that it is suitable for forming, from each piece 9, the first piece 10 as shown on FIGS. 2 and 3.

This first piece 10 comprises a wire crimping portion 11 which is directly connected to the strip 7 through the connection portion 8, and a retention portion 12 which will be described in detail.

Figure 3:
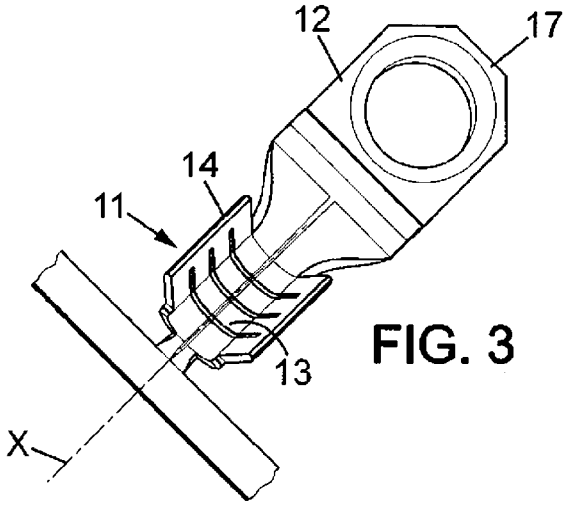
FIG. 3 is another partial perspective of the product of FIG. 2.

The wire crimping portion 11 comprises a partly cylindrical barrel 13 of axis X, from which extend upwardly and outwardly on FIG. 3 two crimping wings 14, which, at this stage of the manufactured process, are still in the uncrimped configuration. The barrel 13 and the crimping wings 14 together define a receiving space 15 for receiving the end of an electrical wire extending along a first longitudinal direction identical to the axis X.

The retention portion 12 comprises a flat platform or flange 60 from which a mechanical retention feature 16 projects upwardly. In the present example, it is shaped as a ring 16 extending circumferentially about a second longitudinal axis Y. In the present example, the axis Y is orthogonal to a plane defined by the first longitudinal direction X and the direction Z of extension of the strip 7. However, the present invention could be used also for other orientations of the second longitudinal axis Y, in particular when the axis Y is parallel to the axis X.

The platform 60 also comprises a second mechanical retention feature 17, which is, in the present example, performed as a tab 17 at the end of the platform 60 opposite to the end of the piece 10 connected to the strip 7.

An intermediate portion 18 is provided between the wire crimping portion 11 and the retention portion 12 for connecting these two portions together. This intermediate portion 18 can for example be designed as a stepped portion for placing the ring 16 in a plane above the wire crimping portion 11. Yet, other geometries are possible, which will depend on the configuration of the electrical connector, and the available space.

Figure 2:
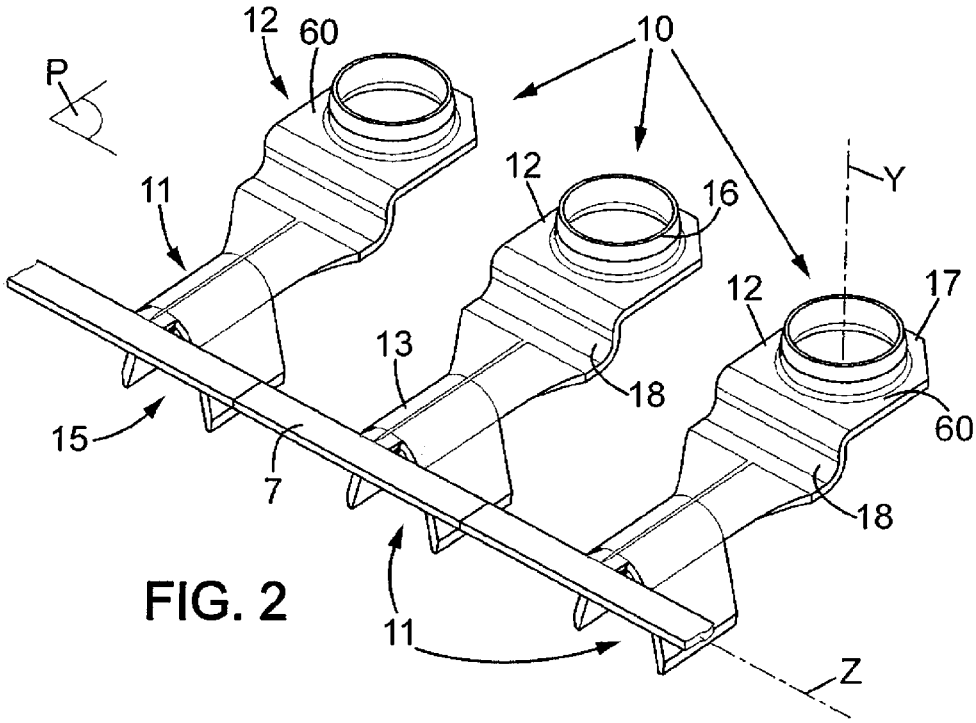
FIG. 2 is a perspective view of a product obtained at the output of the crimping portion forming station of the apparatus of FIG. 1.

In the apparatus of FIG. 1, the product of FIGS. 2 and 3 exits the crimping portion forming station 2 to enter a first assembly station 3. This station also comprises a dispenser 19 (see FIG. 1) of covers 20. One embodiment of a cover is shown on FIGS. 4*a* and 4*b*. The first assembly station 3 is adapted to assemble a cover 20 to each of the first pieces 10 as obtained from the crimping portion forming station and as shown on FIGS. 2 and 3.

Figure 4A:
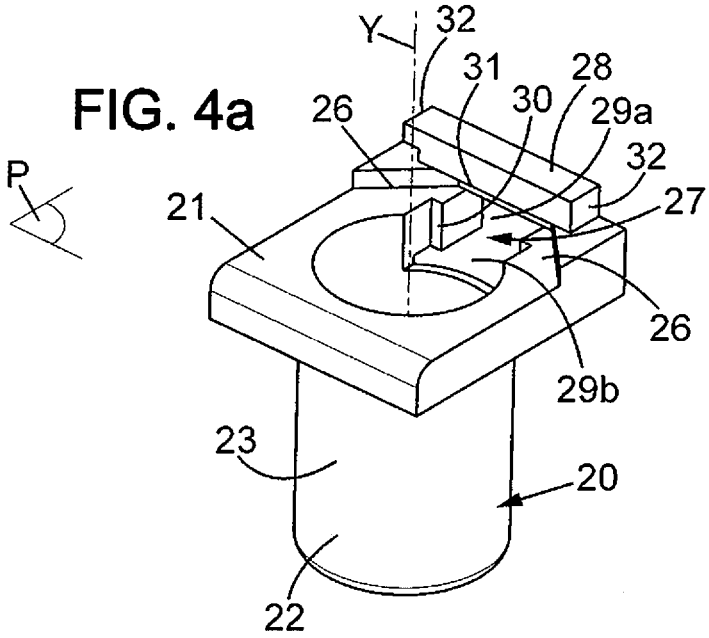
FIG. 4*a* is a perspective view with roughly the same orientation as FIG. 2 of a cover according to a first embodiment.
Figure 4B:
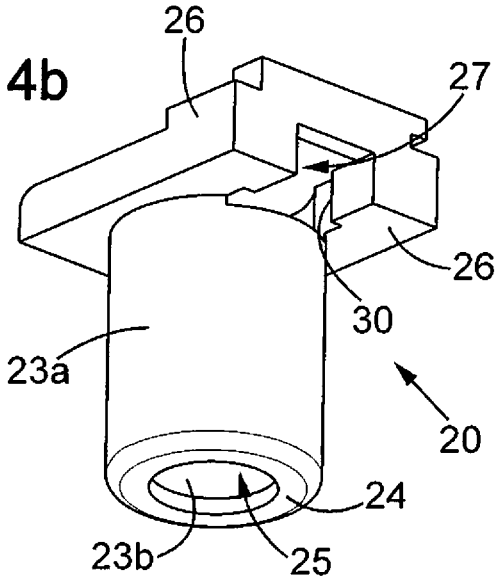
FIG. 4*b* is another perspective view of the cover of FIG. 4*a*.

The covers 20 are made of an electrically insulating material such as, for example, a suitable plastic and might have been moulded to the shape shown on FIGS. 4*a* and 4*b*. Each cover 20 comprises a connecting portion 21 which is for example designed as a platform extending mainly in the reference plane P formed by the axis X and Z, and a protecting portion 22 comprising a cylindrical body 23 and a collar 24. The top end of the cylindrical body is connected to the bottom face of the platform 21, whereas the collar 24 is formed at the bottom end of the body 23. The cylindrical body extends along the longitudinal axis Y and has an external wall 23*a* and an internal wall 23*b* which defines an inside space 25.

The rear end of the platform 21 comprises two legs 26 symmetrical with respect to the X axis and which define, between them, an insertion opening 27. The two legs 26 are connected together by a bridge 28 which extends over the insertion opening 27. The insertion opening 27 comprises a first narrow space 29*a* and a broad space 29*b* closer to the axis of the cylindrical body, so that faces 30, which face frontward, define mechanical locking features for engagement with complementary mechanical locking feature of the connector (to be explained later in relation to FIG. 10).

Figure 7:
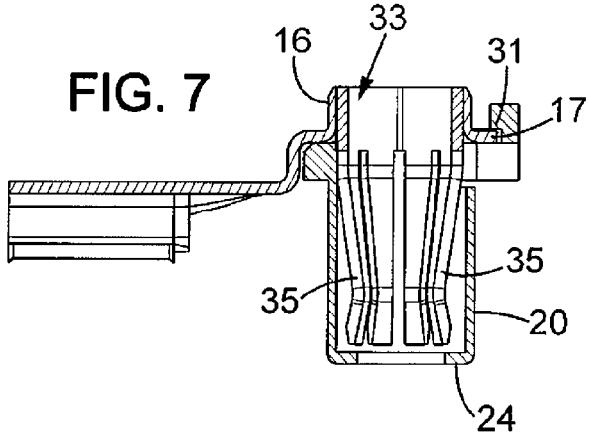
FIG. 7 is a partial sectional view of an electrical contact obtained from the apparatus of FIG. 1, taken along line VII-VII of FIG. 8.

The bridge 28 comprises a downward facing face 31 which defines a mechanical locking feature with the first piece 10 as will be explained below in relation to FIG. 7.

The lateral sides 32 of the bridge 28 are provided with specific geometrical features to provide a fool-proofing feature for engagement with a complementary fool-proofing feature of the connector, as will be explained later in relation to FIGS. 10 to 11*b*.

In the first assembly station 3, the cover 20 which has just been described is assembled with the first piece 10 which was described before, by any suitable way. For example, as shown on FIG. 5, the cover is slid along the axis X toward the first piece 10. The tab 17 of the retention portion 12 of the first piece 10 is inserted in the space 29*a* and 29*b* until the top face of the tab 17 is in contact with the downward facing face 31 of the bridge 28 (see also FIG. 7). The top face of the platform 21 is thus below the bottom face of the platform 60 of the first piece 10.

Referring back to FIG. 1, a second blank 106 is introduced into the power contact portion forming station 4 of the apparatus 1. The second blank 106 is, for example, of similar design as the blank 6, and comprises a strip 107 extending along a longitudinal direction Z and to which pieces 109 are connected through connecting portions 108. However, other embodiments are possible. The power contact portion forming station 4 is suitable to form any of the pieces 109 to a power contact portion 33 such as shown on FIG. 6. Such a power contact portion is for example obtained by forming (stamping) a flat piece 109 and then rolling it to the desired geometry, or by any other suitable way.

Figure 6:
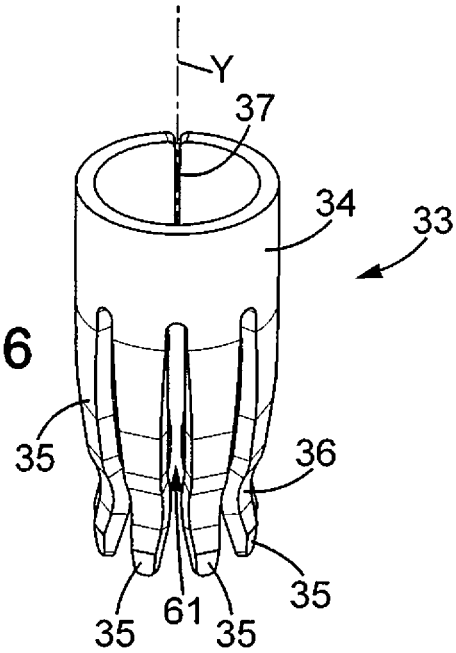
FIG. 6 is a perspective view of a product output from a power contact portion forming station of the apparatus of FIG. 1.

As shown on FIG. 6, the power contact portion 33 is a cylinder of circular cross-section and comprises a body 34 from which extend a plurality of (for example 8) spring legs 35 sensibly along the longitudinal axis Y. The legs 35 extend sensibly downward from the body 34 and inward toward a point of contraflexure 36 from which they are flared outward to their tip. The internal face at the point of contraflexure forms a protrusion which projects inside an internal space 61 for receiving a complementary electrical contact therein. This complementary electrical contact is preferably of diameter greater than the internal diameter of the power contact portion 33 at the level of the protrusions so that the legs will be resiliently biased in contact with this complementary electrical contact upon its insertion in the internal space.

In the present example where the power contact portion 33 is manufactured from rolling a metal blank, a gap 37 may exist between the two longitudinal edges which are brought close to each other during the rolling operation. This gap 37 may be closed, for example, by welding, or by any other suitable means.

Figure 5:
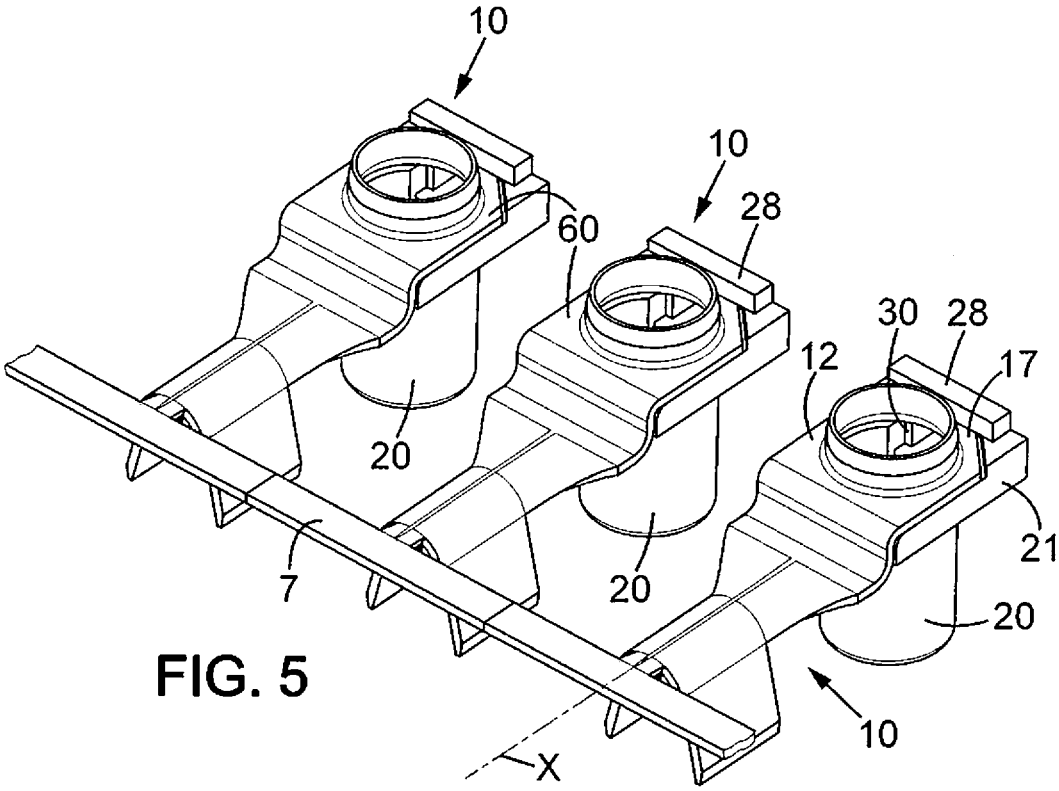
FIG. 5 is a perspective view of the product output from a first assembly station of the apparatus of FIG. 1.

Referring back to FIG. 1, the product, shown on FIG. 5, comprising a strip of first pieces 10 of metal carrying a respective cover, is moved from the first assembly station 3 to the second assembly station 5. Simultaneously, the power contact portion 33 is moved from the power contact portion forming station 4 to the second assembly station 5 to be inserted along the axis Y, from the top, through the ring 16 and the cover 20. The external surface of the body 34 biases in electrical contact with the inner face of the ring 16 for electrical communication between these two pieces. The spring legs 35 are totally enclosed in the cover 20. The body 34 can be welded, if necessary, to the ring 16, or only retained by friction, or any other means. It should be noted that, after the power contact portion 33 has been inserted, it is no longer possible to remove the cover 20 from the electrical contact by sliding along direction X.

Figure 8:
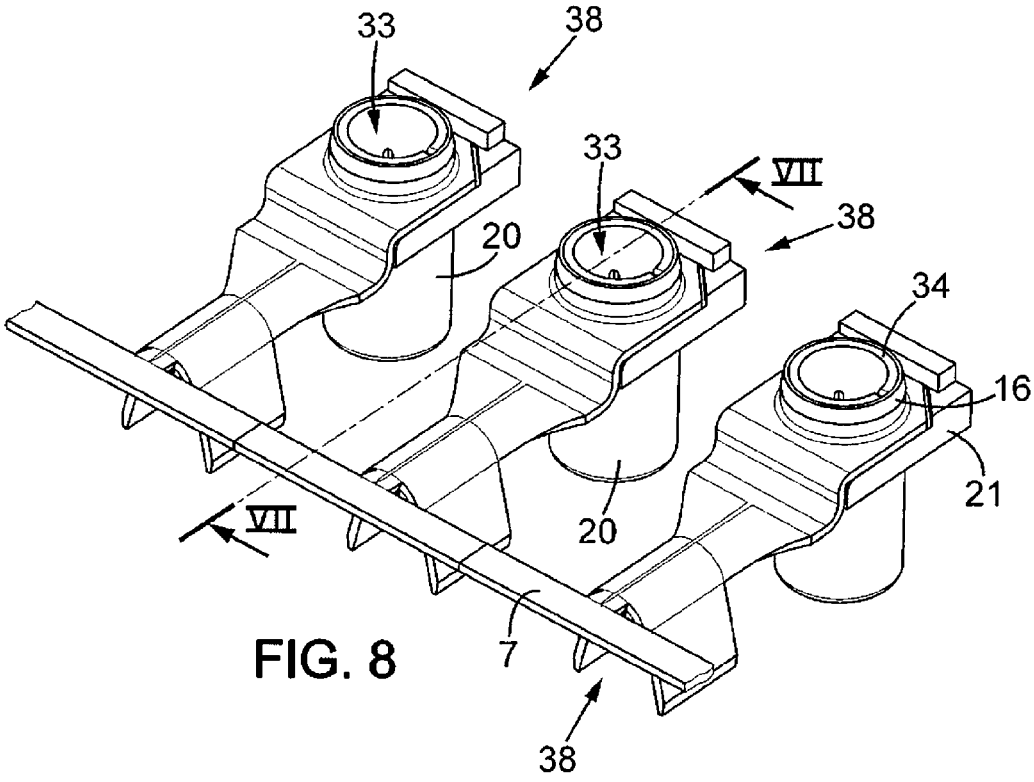
FIG. 8 is a perspective view of a product output from the apparatus of FIG. 1.

FIG. 8 shows the product which is output from the second assembly station 5 shown schematically on FIG. 1. This product comprises a longitudinal strip 7 to which are connected a plurality of electrical contacts 38. For example, the electrical contacts 38 are all identical. In another example, these electrical contacts 38 have different covers having different colours and/or fool-proofing features (see below FIGS. 11*a* and 11*b* for more details about this). The product shown on FIG. 8 can be provided to a third party for cable assembly and terminal insertion in connectors. In alternative, the individual electrical contacts 38 could be separated from the strip 7 before being provided to a cable assembler or a harness maker. As an alternative, the electrical contacts are not necessarily manufactured as two separate conductive pieces. An integral piece comprising a power contact portion and a wire crimping portion might be used.

Figure 9:
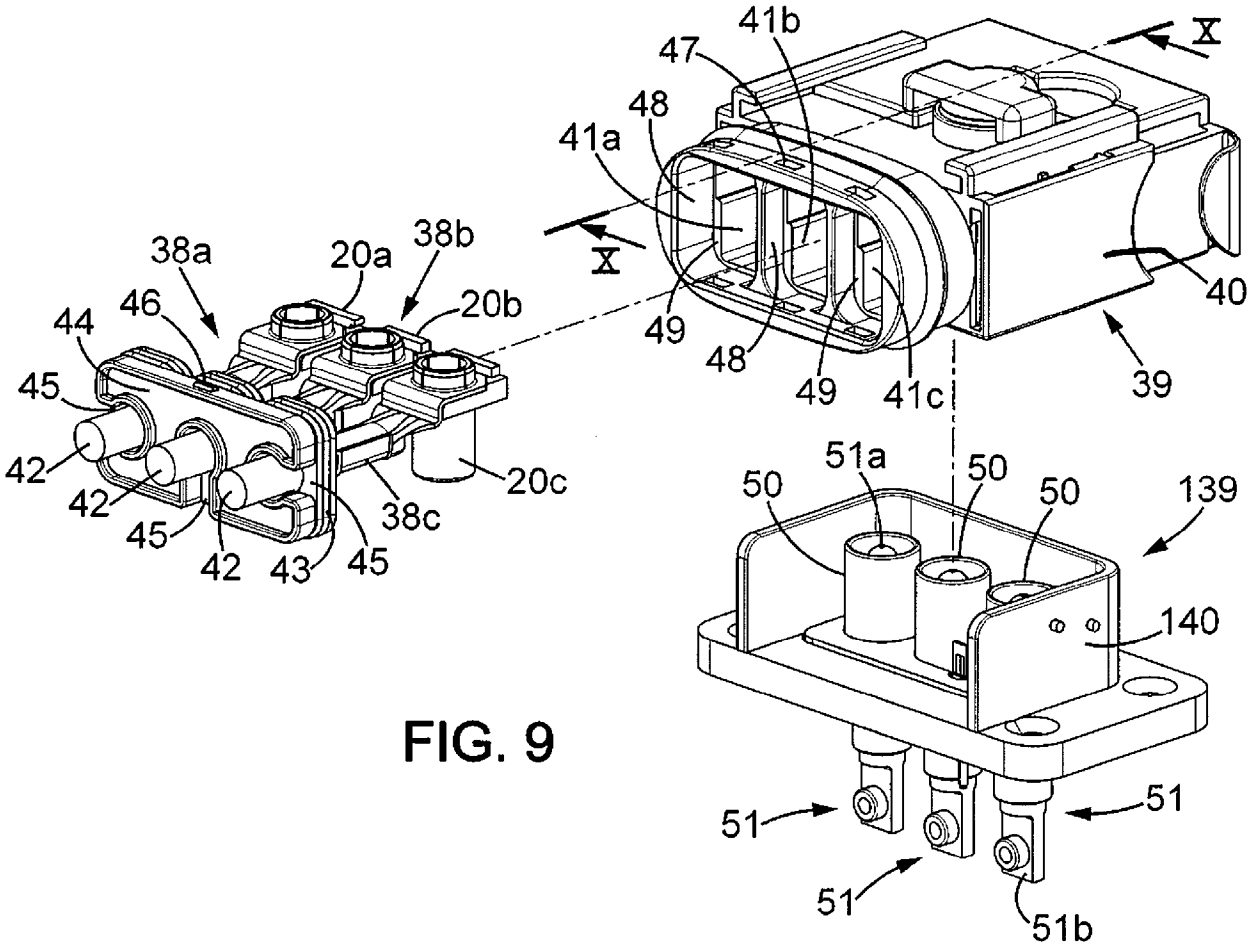
FIG. 9 is an exploded view of an electrical connector assembly incorporating electrical contacts.

An example of a suitable connector for use with the electrical contacts as described above is shown in exploded partial view on FIG. 9. FIG. 9 shows a first electrical connector 39 and a second complementary electrical connector 139 to be mated with.

The first electrical connector 39 is for example made as a dielectric housing 40 defining a plurality of pathways 41*a*, 41*b*, 41*c* which are electrically isolated from one another and extend with a right angle (between axis X and axis Y). Namely, a first end of these openings is provided on a front face of the connector 39, while a second end thereof is provided on its bottom face (not visible on FIG. 9), facing the second connector 139.

As shown on the left side of FIG. 9, three electrical contacts 38*a*, 38*b*, 38*c* are provided which are manufactured according to the above mentioned process. These three terminals differ from one another by each having a different cover 20*a*, 20*b*, 20*c*. The wire crimping portion 11 of each electrical contact is crimped on a respective electrical wire 42 for placing the wire in electrical communication with the electrical contact 38. This can, for example, be performed by folding the crimping wings of the electrical contact on the wire, with a suitable tool comprising a stamping element and an anvil. An insulating joint 43 is slid along the sheath of each wire 42 to the position of FIG. 9 and a grid 44 is placed by inserting the wire 42 through the respective openings 45 of the grid. The grid has locks 46 for engagement with complementary locks 47 of the first connector 39 to lock the grid onto the first connector 39. In this locked position, the joints 43 are circumferentially pressed by internal walls 48 of the first connector 39, and longitudinally pressed between the grid 44 and respective fool-proofing bodies 49 of the respective pathway 41. This will be described in relation to FIG. 10.

The electrical contact 38 is mechanically retained in the housing 40 of the first connector by mechanical engagement of the hook 54 with the faces 30 of the cover (see FIG. 4*a*).

Referring back to FIG. 9, the second electrical connector 139 may for example comprise three cylindrical chimneys 50, cylindrical of circular cross-section of diameter greater than the outer diameter of the covers 20. An electrical contact 51 is provided for each respective chimney 50. These electrical contacts 51 may, for example, comprise a first end 51*a* which extends in the chimney 50, and an opposite second end 51*b* for connection to an electrical appliance.

Figure 10:
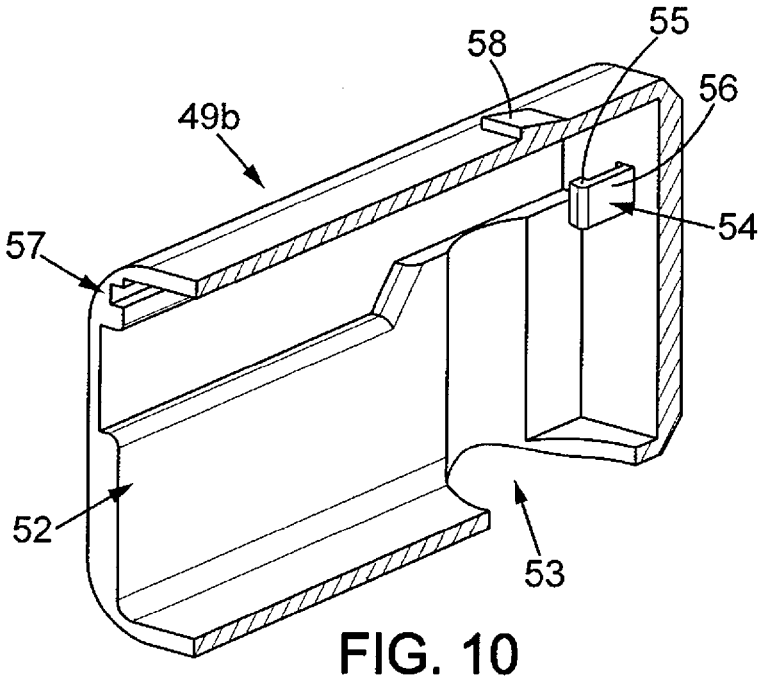
FIG. 10 is a sectional view along line X-X on FIG. 9 of a fool-proofing body of an electrical connector of the assembly of FIG. 9.

FIG. 10 shows a sectional view through the pathway 41*b*. Only the fool-proofing body 49*b* delimiting this pathway is depicted. As explained above, this body 49 has an aperture 52 on the one hand, for receiving the electrical contact 38, and another aperture 53 in its bottom face for receiving the electrical contact 51 of the complementary connector. A locking tool 54 is provided on the back face of the body 49*b*, for example as a hook extending from this back face toward the aperture 52 and having a catching portion 55 born by a resilient arm 56.

The body 49*b* has a fool-proofing relief 57 in the top left corner of its profile, which is provided with a given geometry. The body 49*b* is for example made from moulded plastic and may for example be provided with a pigment of a first colour.

It is locked to the housing 40 of the first electrical connector through any suitable means, such as spring lances 58 which engage with complementary features 59 (FIG. 12) of the internal faces of the housing 40.

Figure 11A:
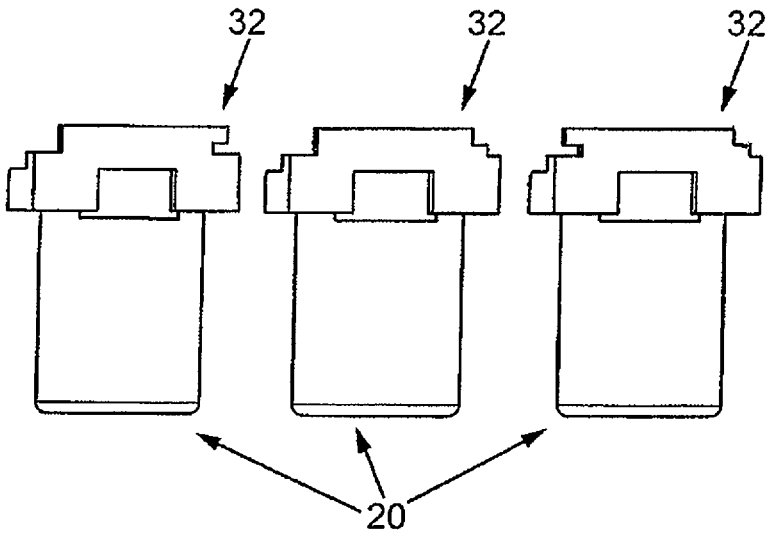
FIG. 11*a* is a rear view of the three covers used in the connector of FIG. 9.
Figure 11B:
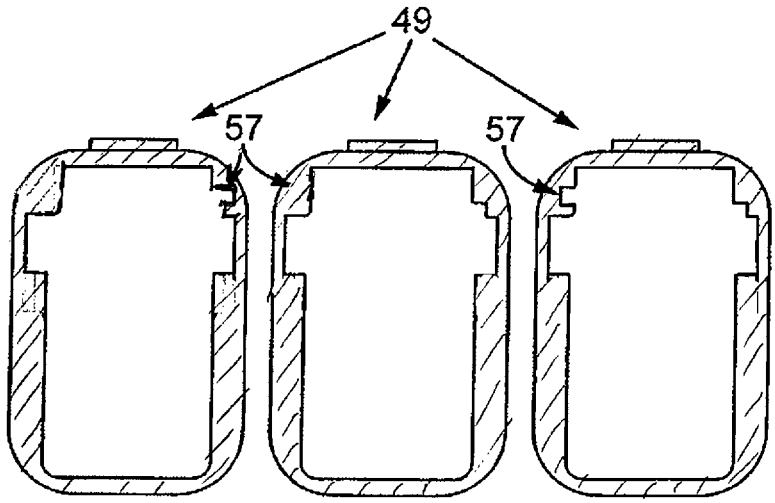
FIG. 11*b* is a schematic cross section of the three fool-proofing bodies of the connector of FIG. 9.

As shown on FIG. 11*a* and 11*b*, each of the covers 20 has a different fool proofing feature 32 with a specific geometry. Further, although this is not visible on FIG. 11*a*, each of the covers may incorporate a respective pigment so that they all have different colours. As shown on FIG. 11*b*, the fool-proofing bodies 49 all have a different fool proofing geometry 57. Further, they all include a different pigment, which provides different colours. For example, the colour of one of the bodies 49 is associated to, preferably is the same as, the colour of a respective cover. Further, the geometries 32 and 57 are chosen so that, among the three covers of FIG. 11*a*, only one can enter a respective body 49, and is prevented to enter the other bodies. Further, each body can receive only one of the covers. Preferably, the cover which is allowed to be inserted in a respective box is provided with a colour associated to the colour of that box.

Figure 12:
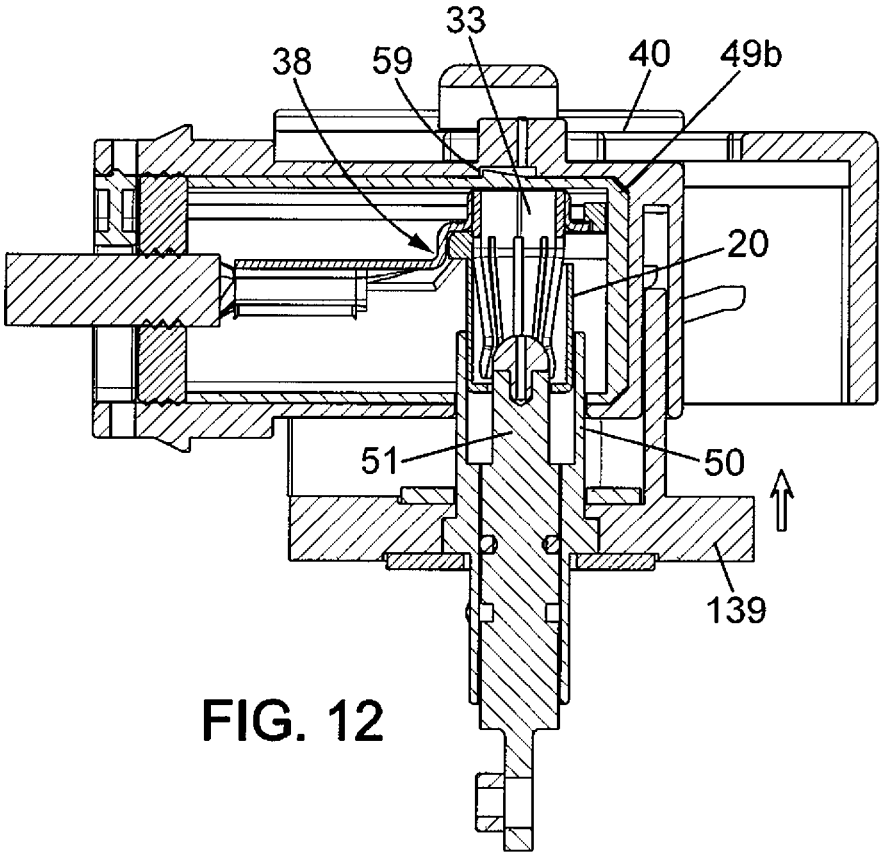
FIG. 12 is a sectional view along line X-X on FIG. 9, of the partly assembled electrical connector assembly.

The connector assembly is shown on FIG. 12 with the complementary connector 139 partly assembled. As shown, each electrical contact 38 is a right-angled contact in that its two connection axes X and Y are perpendicular to one another. The cover 20 is guided into a respective chimney 50 and the complementary electrical contact 51 is placed in electrical contact with the power contact portion 33 of the electrical contact 38.

The invention claimed is:

1. An electrical contact comprising:

a wire crimping portion comprising a receiving space adapted for receiving an electrical wire, and at least one wing adapted to be crimped on the electrical wire received in the receiving space and comprising a ring defining an aperture;

a unitary cylindrical power contact portion frictionally retained within the ring aperture of the wire crimping portion thereby electrically connecting the wire crimping portion and the power contact portion defining a plurality of spring legs, each leg depending from the body and configured to be contacted with the complementary contact; and an electrically insulating cover covering said spring legs and mechanically retained on one portion chosen among the wire crimping portion and the power contact portion.

2. Electrical contact according to claim 1, comprising a first electrically conductive piece comprising the wire crimping portion, and a second distinct electrically conductive piece comprising the power contact portion, wherein the first and second pieces comprise a respective first and second locking portions, said first and second locking portions being adapted to engage each other to frictionally lock said first and second pieces to one another.

3. Electrical contact according to claim 2, wherein said second piece is formed from a blank which is stamped and rolled.

4. Electrical contact according to claim 1, wherein the receiving space is adapted for receiving an electrical wire extending along a first longitudinal direction (X), wherein the power contact portion extends around a second longitudinal direction (Y) for receiving the complementary contact, wherein the first (X) and second (Y) longitudinal directions are orthogonal.

5. Electrical contact according to claim 1, wherein the cover comprises:

a connecting portion adapted to engage with said one portion chosen among the wire crimping portion and the power contact portion to lock the cover onto said portion, a protecting portion comprising a body having an inner cylindrical wall defining an inside space, wherein said spring legs are inside said inside space.

6. Electrical contact according to claim 5, wherein the inner cylindrical wall extends from a first end connected to the connecting portion to an opposite second end connected to a radially inward extending collar.

7. Electrical contact according to claim 1, wherein said cover comprises a locking feature adapted to engage with a complementary locking feature of an electrically insulative housing, for mechanical retention of the electrical contact in said housing.

8. Electrical contact according claim 1, wherein said cover comprises a fool-proofing feature adapted to engage with a complementary fool-proofing body for a first pathway of an electrically insulative housing for allowing an insertion of said electrical contact in said first pathway, and to engage with a complementary fool-proofing body for a second pathway of the electrically insulative housing for preventing an insertion of said contact in said second pathway.

9. Electrical contact according to claim 1, wherein the cover does not cover the wing.

10. A product comprising a connection strip, and a plurality of electrical contacts each according to claim 1 and mechanically connected to the connection strip.

11. An electrical wire assembly comprising:

an electrically insulating housing comprising a plurality of pathways;

a plurality of electrical contacts each according to claim 1, each electrical contact being adapted to be inserted in a respective pathway of the housing; and a plurality of electrical wires, each connected to a respective electrical contact.

12. An assembly according to claim 11, further comprising a complementary connector adapted to be mated with the housing, said complementary connector comprising a plurality of mating electrical contacts each adapted to be placed in contact with the spring legs of a respective electrical contact held in the housing, wherein the complementary connector comprises a plurality of electrically insulating cylindrical passageways each surrounding a respective mating electrical contact, and adapted to engage with the respective cover by complementarity of shapes.

13. A method of manufacturing an electrical contact comprising:

forming a wire crimping portion comprising a receiving space adapted for receiving an electrical wire and comprising a ring defining an aperture;

forming a cylindrical power contact portion from a single piece of material that defines a connecting space for connection with a complementary contact, said power contact portion including a body, and a plurality of spring legs, each leg depending from the body and configured to be contacted with the complementary contact;

frictionally fixing said power contact portion within the aperture of said wire connection portion, thereby electrically connecting the power contact portion to the wire crimping portion; and fixing an electrically insulating cover covering said spring legs, and not covering the wing, on one portion chosen among the wire crimping portion and the power contact portion.

* * * * *